US011642702B2

(12) United States Patent
Aas et al.

(10) Patent No.: US 11,642,702 B2
(45) Date of Patent: May 9, 2023

(54) SELF-CLEANING OPTICAL HOUSING ARRANGEMENT

(71) Applicant: Submerged AS, Rissa (NO)

(72) Inventors: Lars Martin Sandvik Aas, Lysaker (NO); Håvard Lein Braa, Rissa (NO)

(73) Assignee: SUBMERGED AS, Rissa (NO)

( * ) Notice: Subject to any disclaimer, the term of this patent is extended or adjusted under 35 U.S.C. 154(b) by 50 days.

(21) Appl. No.: 17/436,497

(22) PCT Filed: Feb. 18, 2020

(86) PCT No.: PCT/NO2020/050042

§ 371 (c)(1),
(2) Date: Sep. 3, 2021

(87) PCT Pub. No.: WO2020/190144

PCT Pub. Date: Sep. 24, 2020

(65) Prior Publication Data

US 2022/0176416 A1 Jun. 9, 2022

(30) Foreign Application Priority Data

Mar. 21, 2019 (NO) ..... 20190363

(51) Int. Cl.

| | |
|---|---|
| ***B08B 13/00*** | (2006.01) |
| ***B08B 1/00*** | (2006.01) |
| ***B08B 1/04*** | (2006.01) |
| ***B63G 8/38*** | (2006.01) |

(52) U.S. Cl.

CPC ..... *B08B 1/002* (2013.01); *B08B 1/006* (2013.01); *B08B 1/04* (2013.01); *B63G 8/38* (2013.01)

(58) Field of Classification Search

None

See application file for complete search history.

(56) References Cited

U.S. PATENT DOCUMENTS

2013/0104933 A1* 5/2013 Aldred ..... G03B 17/561 134/6

FOREIGN PATENT DOCUMENTS

| | | |
|---|---|---|
| CN | 106791323 | 5/2017 |
| CN | 207057088 | 3/2018 |
| GB | 2525386 | 10/2015 |

(Continued)

OTHER PUBLICATIONS

International Search Report and Written Opinion mailed in PCT/NO2020/050042 dated Aug. 5, 2020 (pages), 3 pages for search report, 6 pages for written opinion.

(Continued)

*Primary Examiner* — Eric W Golightly

(74) *Attorney, Agent, or Firm* — Wissing Miller LLP

(57) ABSTRACT

The invention relates to a self-cleaning optical housing arrangement comprising a first cylindrical shell, a shaft, a motor, a second cylindrical shell, a cleaning pad, a shaft magnet and a cylinder magnet. The shaft magnet and the cylinder magnet are arranged in order to magnetically interact such that a rotation of the shaft causes the shaft magnet to exert a force on the cylinder magnet causing the second cylindrical shell to rotate with the shaft. The cleaning pad will upon rotation of the shaft and the second cylindrical shell, sweep across and thereby clean at least a part of an outer surface of the first cylindrical shell.

15 Claims, 6 Drawing Sheets

(56) References Cited

FOREIGN PATENT DOCUMENTS

| | | | | |
|---|---|---|---|---|
| JP | H10164289 | | | 6/1998 |
| KR | 20170074923 | A | * | 6/2017 |
| WO | 20110055099 | | | 5/2011 |
| WO | 2014103726 | | | 7/2014 |
| WO | 2016058105 | | | 4/2016 |

OTHER PUBLICATIONS

Norwegian Search Report mailed in 20190363 dated Sep. 30, 2019 (2 pages).

* cited by examiner

SELF-CLEANING OPTICAL HOUSING ARRANGEMENT

CROSS-REFERENCE TO RELATED APPLICATIONS

This application is a 371 of PCT/NO2020/050042 filed on Feb. 18, 2020, published on Sep. 24, 2020 under publication number WO 2020/190144 A1, which claims priority benefits from Norwegian Patent Application No. 20190363 filed Mar. 21, 2019, both of which are incorporated herein in their entirety by reference.

TECHNICAL FIELD

The invention relates to a self-cleaning optical housing arrangement for underwater optical systems that utilizes a mechanical cleaning process in order to avoid biofouling. The housing arrangement comprises a first cylindrical shell, a shaft, a motor, a second cylindrical shell element, a cleaning pad, a shaft magnet and a cylinder magnet.

BACKGROUND

Biofouling is considered a limiting factor when performing ocean monitoring using permanent or long time installations. Optical structures immersed in seawater will under normal conditions be rapidly covered by biofouling, making them useless until cleaned. Systems used for high resolution or high intensity monitoring is particularly sensitive to any optical disturbances, motivating the search for solutions for how to avoid biofouling.

The most common method for avoiding biofouling on optical systems underwater is to add copper material as close to the optical window as possible. This method limits the biofouling, at least for a limited time. Copper is considered potentially toxic, and is therefore prohibited in many situations.

Another more recently developed technique for avoiding biofouling is the use of a nanostructured surface on optical windows. Tear will however after some time remove the nanostructures, and the effect is reduced. The surface will then have to be recoated, a process that for many optical systems is either expensive or impossible to conduct.

It is the aim of the present invention to provide an improved solution for how to reduce the problem with biofouling on underwater optical installations.

SUMMARY OF THE INVENTION

The invention provides a self-cleaning optical housing arrangement comprising a first cylindrical shell, comprising a first transparent portion, a shaft, arranged with a shaft axis of rotation along the first cylindrical shell central axis, a motor, connected to the first cylindrical shell and to the shaft, where the motor is configured to rotate the shaft relative to the first cylindrical shell, a second cylindrical shell element, arranged at least in part around the first cylindrical shell and configured to rotate around the first cylindrical shell, the second cylindrical shell element is provided with a second transparent portion configured to be at least in part aligned with the first transparent portion, a cleaning pad, connected to the second cylindrical shell element, and arranged at least in part between the first cylindrical shell and the second cylindrical shell element so that it physically contacts the first cylindrical shell outer surface, a shaft magnet, connected to the shaft, a cylinder magnet, connected to the second cylindrical shell element, where the shaft magnet and the cylinder magnet are arranged in order to magnetically interact such that a rotation of the shaft causes the shaft magnet to exert a force on the cylinder magnet that further causes the second cylindrical shell element to rotate with the shaft, and where, the cleaning pad, upon rotation of the shaft and the second cylindrical shell element, sweeps across, and thereby cleans, at least a part of the outer surface of the first transparent portion.

The optical housing arrangement comprises according to one embodiment of the invention a first cap arranged on a first end of the first cylindrical shell such that it forms a watertight seal with the first cylindrical shell.

According to another embodiment of the invention the motor is connected with the first cylindrical shell via the first cap.

The optical housing arrangement comprises according to yet another embodiment of the invention a second cap, arranged on a second end of the first cylindrical shell such that it forms a watertight seal with the first cylindrical shell, and a bearing connected to the second cap and to the shaft, configured to secure the shaft to the second cap while allowing the shaft to rotate.

The second transparent portion is according to yet another embodiment of the invention an opening.

According to yet another embodiment of the invention the inner volume of the first cylindrical shell is partitioned by one or more essentially non-transparent walls.

The first cylindrical shell comprises according to yet another embodiment of the invention a plurality of cylindrical shell segments connected with each other, where the plurality of cylindrical shell segments are partitioned by one or more essentially non-transparent walls.

The optical housing arrangement further comprises according to yet another embodiment of the invention an optical sensor, configured to detect light from outside the optical housing arrangement, and a light emitting device, configured to illuminate light out of the optical housing arrangement, where the optical sensor and the light emitting device are connected to the shaft and are arranged in the inner volume of the first cylindrical shell.

The optical housing arrangement further comprises according to yet another embodiment of the invention an optical sensor, configured to detect light from outside the optical housing arrangement, and a light emitting device, configured to illuminate light out of the optical housing arrangement, where the optical sensor and the light emitting device are connected to the shaft, are arranged in the inner volume of the first cylindrical shell and are separated by an essentially non-transparent wall.

The shaft comprises according to yet another embodiment of the invention a plurality of parts connected with each other.

The optical housing arrangement further comprises according to yet another embodiment of the invention a plurality of shaft magnets, each connected to the shaft, and a plurality of a cylinder magnets, each connected to the second cylindrical shell element, where the shaft magnets and the cylinder magnets are arranged in order to magnetically interact such that a rotation of the shaft causes the shaft magnets to exert a force on the cylinder magnets that further causes the second cylindrical shell element to rotate with the shaft.

The first cylindrical shell consists according to yet another embodiment of the invention a transparent material.

The cleaning pad has according to yet another embodiment of the invention an elongated shape and where the second cylindrical shell element has an elongated slot with a shape suitable for receiving the cleaning pad.

The optical housing arrangement further comprises according to yet another embodiment of the invention a first and a second cleaning pad magnet arranged in the cleaning pad, and a first and a second mounting magnet, arranged adjacent to the elongated slot, where the first and second mounting magnets are configured to exert a force on the first and a second cleaning pad magnets respectively such that the cleaning pad is pressed against the outer surface of the first cylindrical shell.

According to yet another embodiment of the invention the first and second cleaning pad magnets are respectively arranged in a first and a second distal end of the cleaning pad, where the first and second mounting magnet are respectively arranged adjacent to a first and second distal end of the elongated slot.

Other advantageous features will be apparent from the accompanying claims.

BRIEF DESCRIPTION OF THE DRAWINGS

In order to make the invention more readily understandable, the discussion that follows will refer to the accompanying drawings, in which.

DETAILED DESCRIPTION OF THE INVENTION

In the following, general embodiments as well as particular exemplary embodiments of the invention will be described. References will be made to the accompanying drawings. It shall be noted, however, that the drawings are exemplary embodiments only, and that other features and embodiments may well be within the scope of the invention as claimed.

The present invention provides an optical housing arrangement suitable for use underwater and for housing various optical equipment, e.g. optical sensors, cameras, detectors, light sources, lenses, polarization filters, etc.

Figure 1:
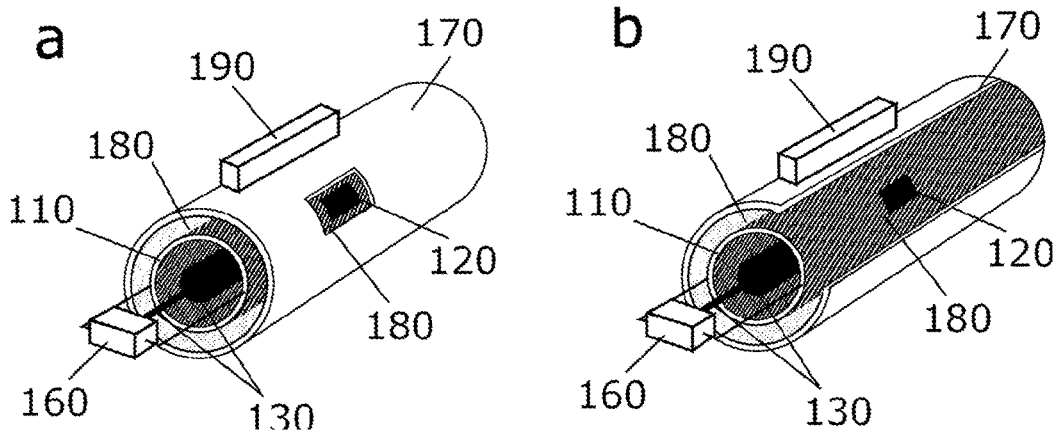
FIG. 1*a* is a schematic representation of a self-cleaning optical housing arrangement comprising a first cylindrical shell, a shaft, a motor, a second cylindrical shell element and a cleaning pad.
FIG. 1*b* is a schematic representation of a self-cleaning optical housing arrangement comprising a first cylindrical shell, a shaft, a motor, a second cylindrical shell element and a cleaning pad.
Figure 2:
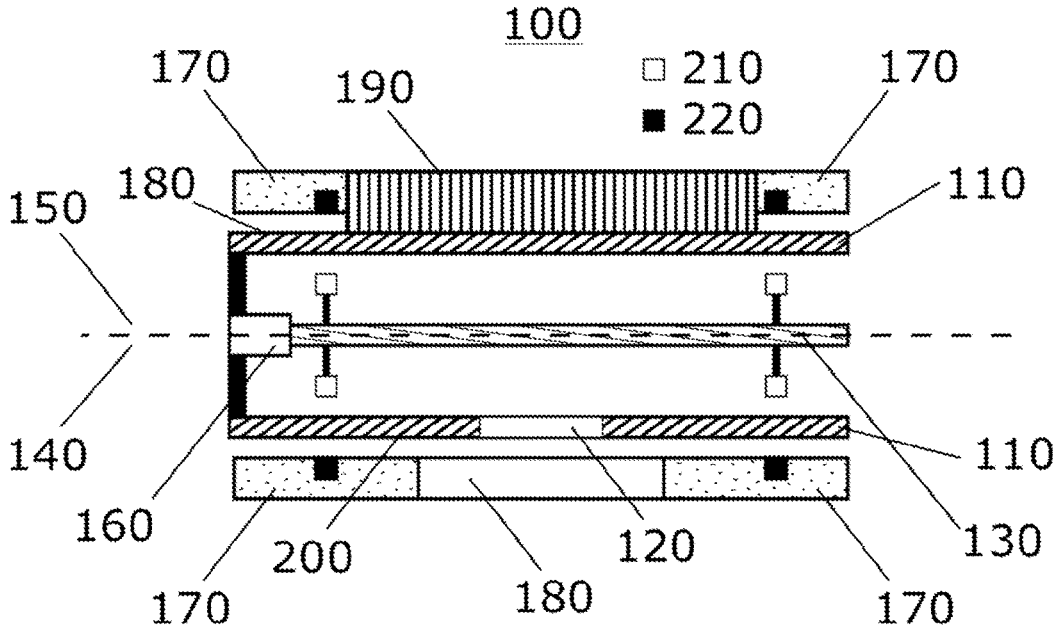
FIG. 2 is a schematic representation of a self-cleaning optical housing arrangement comprising a first cylindrical shell, a shaft, a motor, a second cylindrical shell element and a cleaning pad, a shaft magnet and a cylinder magnet.

The housing arrangement 100 comprises as schematically illustrated in FIGS. 1 and 2 a first cylindrical shell 110, a shaft 130, a motor 160, a second cylindrical shell element 170, a cleaning pad, a shaft magnet 210 and a cylinder magnet 220. The housing arrangement 100 is sized such that it may house various optical equipment inside the inner volume 290 of the first cylindrical shell 110. The first cylindrical shell 110 further comprises a first transparent portion 120 in order to enable electromagnetic communication, e.g. visual communication, between its inner volume 290 and its exterior. The first transparent portion 120 may for example be a window made from one or a combination of transparent materials, such as soda-lime glass, silica, a transparent plastic, or any other suitable material. The inner volume 290 of a cylindrical shell is according to the invention the cylindrical volume of the cylindrical shell. This should not be confused by the volume of the shell itself, i.e. the volume of the shell part of a cylindrical shell.

As illustrated in FIGS. 1 and 2, the optical housing arrangement 100 further comprises a shaft 130 and a motor 160, where the shaft 130 is arranged with a shaft axis of rotation 140 along the first cylindrical shell central axis 150. The motor 160 is connected to both the shaft 130 and to the first cylindrical shell 110 such that it can rotate the shaft 130 relative to the first cylindrical shell 110. The shaft 130 does not have to be arranged exactly along the first cylindrical shell central axis 150, and the term "arranged with a shaft axis of rotation 140 along" may thus in the context of the invention be interpreted as sufficiently along so as to allow the shaft 130 to rotate at least in part relative to the first cylindrical shell 110. A motor may in the context of the present invention be considered as a motor assembly. A motor assembly may here comprise a motor, e.g. an electrical motor, and optionally one or more elements such as a gear mechanism, electrical power delivery coupling, transmission shaft, torque transfer mechanism, and/or other elements suitable for connecting the motor 160 to the shaft 130.

The second cylindrical shell element 170 is as illustrated in FIGS. 1 and 2 arranged at least in part around the first cylindrical shell 110 and configured to be rotated around the first cylindrical shell 110. The second cylindrical shell element 170 may be interpreted as being arranged around the first cylindrical shell 110 and configured to being rotated at least in part around the first cylindrical shell 110. The second cylindrical shell element may in the context of the invention be interpreted as a full cylindrical shell, such as illustrated in FIG. 1 *a*, or a fraction of a cylindrical shell, e.g. as illustrated in FIG. 1*b*.

Any cylindrical shell or cylindrical shell element may in the context of the present invention be considered as essentially cylindrical. The structure of the optical housing arrangement will tolerate a deviation from a perfect cylindrical shapes as long as the second cylindrical shell element is shaped such that it may rotate at least in part around the first cylindrical shell. The first cylindrical shell and second cylindrical shell element may thus in the context of the present invention be considered as sufficiently cylindrically shaped so as to allow for the second cylindrical shell element to rotate around the first cylindrical shell.

The second cylindrical shell element 170 comprises as illustrated in FIG. 2 a second transparent portion 180. This second transparent portion 180 may be aligned with the first transparent portion 120 of the first cylindrical shell 110 in order to enable electromagnetic communication, e.g. visual communication, between the inner volume 290 of the first cylindrical shell 110 and the exterior of the second cylindrical shell element 170. The alignment of the first transparent portion 120 and the second transparent portion 180 may be achieved e.g. upon rotation of the second cylindrical shell element 170 around the first cylindrical shell 110. The second transparent portion 180 may be a window made from one or a combination of transparent materials, such as soda-lime glass, silica, a transparent plastic, or any other suitable material.

A cleaning pad is as illustrated in FIGS. 1 and 2 connected to the second cylindrical shell element 170. The cleaning pad can here be seen as arranged at least in part between the first and second cylindrical shell elements, such that it physically contacts the first cylindrical shell outer surface 200. The cleaning pad will thus upon rotation of the second cylindrical shell element 170, sweep across, and consequently clean, the outer surface 200 of the first cylindrical shell 110. Any number of cleaning pads may in principle be used. The material of the cleaning pad may in principle be any type of material suitable for cleaning the outer surface of the first transparent portion when moved across this surface. The cleaning pad may for example comprise a sponge, fibre cloth, wiper or a textured rubber.

FIG. 2 illustrates a schematic illustration of the self-cleaning optical housing arrangement 100 that comprises a shaft magnet 210 connected to the shaft 130, and a cylinder magnet 220 connected to the second cylindrical shell element 170. A shaft magnet 210 may in the context of the invention be considered as any magnet connected to the shaft 130, and may be e.g. a permanent magnet, a temporary magnet or an electromagnet. A cylinder magnet 220 may in the context of the present invention be considered as any magnet connected to the second cylindrical shell element 170, and may be e.g. a permanent magnet, a temporary magnet or an electromagnet.

At least one shaft magnet 210 and at least one cylinder magnet 220 are according to the invention arranged such that they magnetically interact with each other, either through attractive or repulsive forces. Such interaction may be achieved as visualized in FIG. 2, where a shaft magnet 210 is positioned adjacent to a cylinder magnet 220 in a distance from the shaft 130. The interaction between the shaft magnet 210 and the cylinder magnet 220 will according to one embodiment of the invention be such that a rotation of the shaft 130 causes the shaft magnet 210 to exert a force on the cylinder magnet 220 that further causes the second cylindrical shell element 170 to rotate with the shaft 130. The magnetic interaction between the magnets is contactless, and enables the motor 160 to rotate the second cylindrical shell element around the first cylindrical shell 110 by rotating the shaft 130.

A rotation of the second cylindrical shell element 170 around the first cylindrical shell 110 causes the cleaning pad to sweep across, and consequently clean the outer surface 200 of the first cylindrical shell 110. The cleaning pad may as illustrated in FIG. 1 be aligned such that it may sweep across, and consequently clean at least a part of the outer surface of the first transparent portion 120 of the first cylindrical shell 110.

The second cylindrical shell element 170 is according to the invention arranged at least in part around the first cylindrical shell and configured to be rotated around the first cylindrical shell. The second cylindrical shell element 170 may be arranged adjoining, adjacent to, or at a non-zero distance from the first cylindrical shell, and may be held in place by magnets or by any suitable support structure. The second cylindrical shell element 170 may upon rotation around the first cylindrical shell simply slide over the first cylindrical shell, or alternatively be supported by some support structure as it rotates around the first cylindrical shell.

FIG. 2 illustrates an embodiment of the invention where the optical housing arrangement 100 comprises a plurality of shaft magnets 210 and a plurality of cylinder magnets 220. The shaft magnets 210 and the cylinder magnets 220 are here arranged in order to magnetically interact such that a rotation of the shaft 130 causes the shaft magnets 210 to exert a force on the cylinder magnets 220 that further causes the second cylindrical shell element 170 to rotate with the shaft 130. The use of a plurality of shaft magnets 210 and cylinder magnets 220 may be beneficial in order to achieve e.g. a more even rotation force, more torque, and a more precise alignment of the second cylindrical shell element 170 relative to the first cylindrical shell 110. The plurality of shaft magnets 210 and cylinder magnets 220 may according to this embodiment of the invention be arranged in any suitable fashion. They may e.g. be arranged symmetrically around the shaft axis of rotation 140.

Figure 3:
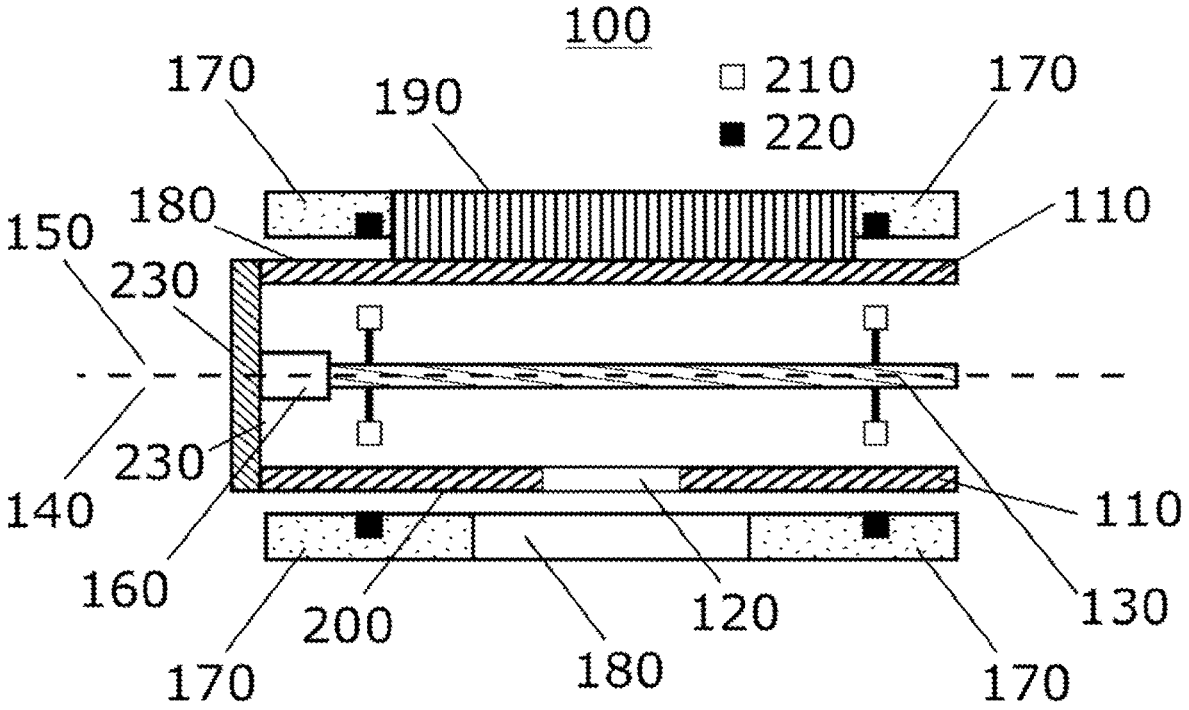
FIG. 3 is a schematic representation of a self-cleaning optical housing arrangement comprising a first cap.

FIG. 3 illustrates an embodiment of the invention where the optical housing arrangement 100 further comprises a first cap 230 arranged on a first end 240 of the first cylindrical shell 110. The first cap 230 forms a watertight seal with the first cylindrical shell 110, where the seal e.g. may be achieved by using a gasket, weld or any other suitable watertight sealing element/method. The first cap 230 may alternatively be an integral part of the cylindrical shell. The motor 160 may in this embodiment of the invention be connected with the first cylindrical shell 110 via the first cap 230. This is illustrated in FIG. 3, where the motor 160 can be seen as located inside the first cylindrical shell 110 and as adjoining the first cap 230. The first cap 230 may additionally support, and hold in place the second cylindrical shell element 170 while allowing it to rotate relative to the first cylindrical shell 110.

Figure 4:
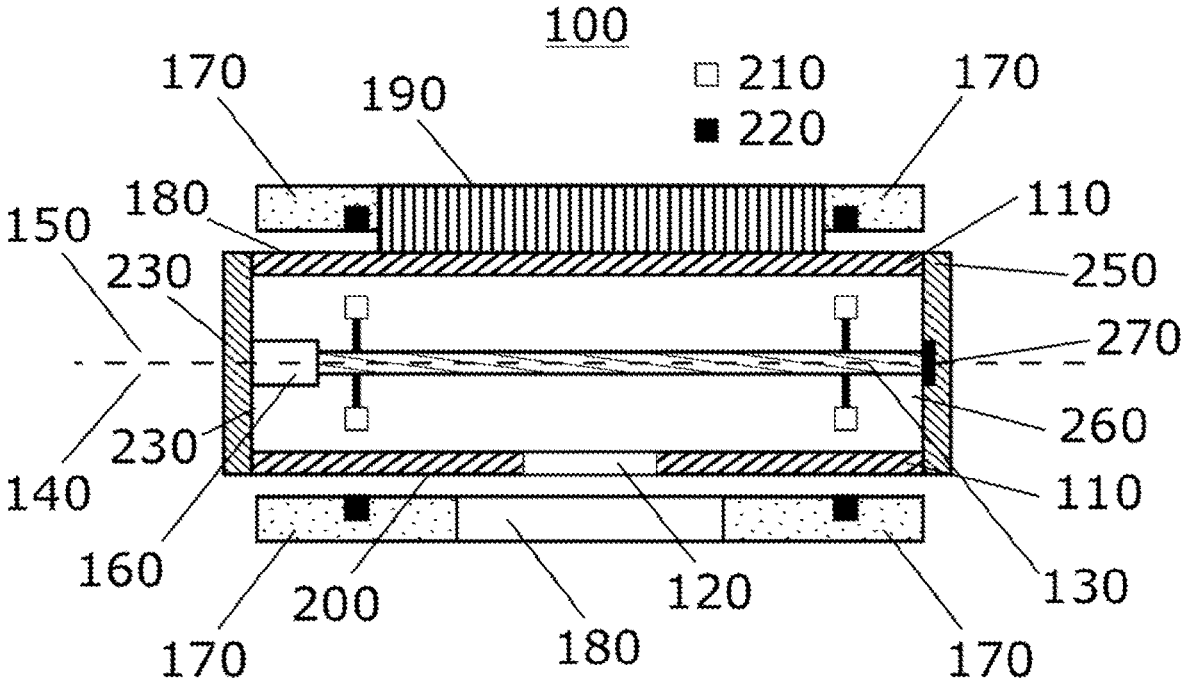
FIG. 4 is a schematic representation of a self-cleaning optical housing arrangement comprising a second cap, and a bearing.

FIG. 4 illustrates an embodiment of the invention where the optical housing arrangement 100 further comprises a second cap 250 arranged on a second end 260 of the first cylindrical shell 110. The second cap 250 forms a watertight seal with the first cylindrical shell 110, where the seal e.g. may be achieved by using a gasket, weld or any other suitable watertight sealing element/method. The second cap 250 may alternatively be an integral part of the cylindrical shell. The second cap 250 may further be fitted with a bearing 270 suitable for receiving the shaft 130 in a manner that allows the shaft 130 to rotate, such as e.g. a ball bearing. The bearing 270 here also acts as a fastening point that secures the shaft 130 to the second cap 250 while allowing the shaft 130 to rotate. The second cap 250 may additionally support, and hold in place the second cylindrical shell element 170 while allowing it to rotate relative to the first cylindrical shell 110.

Figure 5:
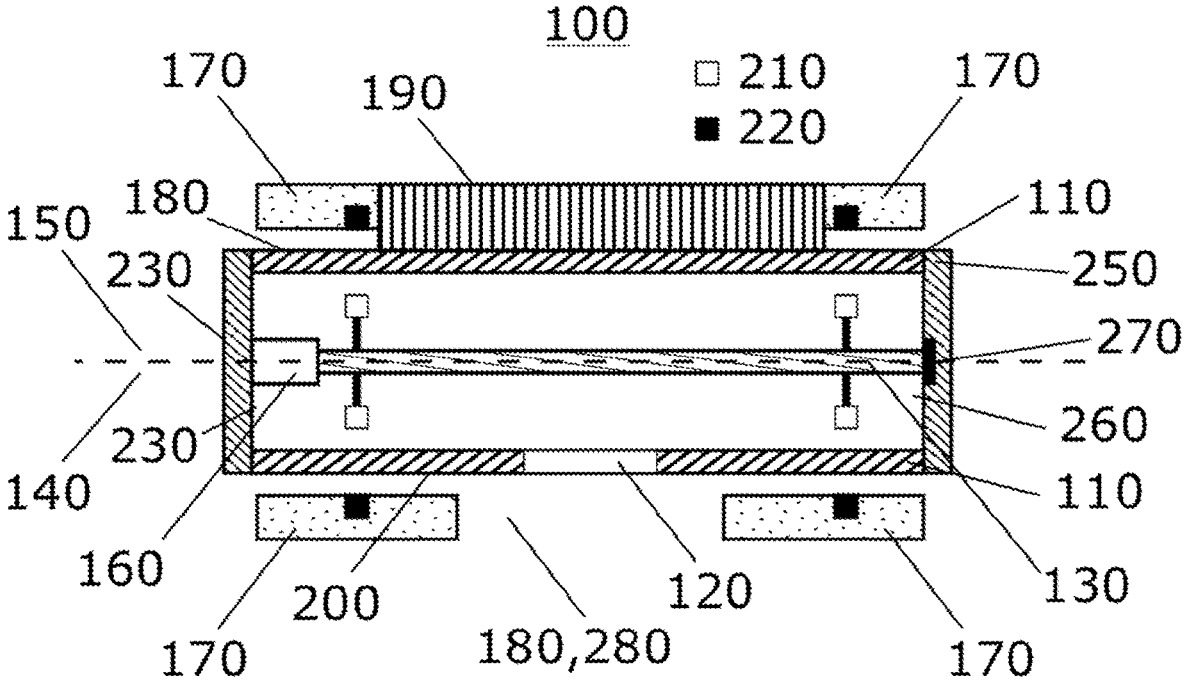
FIG. 5 is a schematic representation of a self-cleaning optical housing arrangement where the second transparent portion is an opening.

FIG. 5 illustrates the optical housing arrangement 100 where the second transparent portion 180 is an opening 280. An opening 280 in the second cylindrical shell element 170 may be beneficial in order to allow, biofouling, dirt and other impurities to escape from the surface of the first cylindrical shell 110, e.g. after having been cleaned of using the cleaning pad. The second cylindrical shell element 170 may additionally or alternatively be supplied with one or more openings in order to allow dirt to escape.

Figure 6:
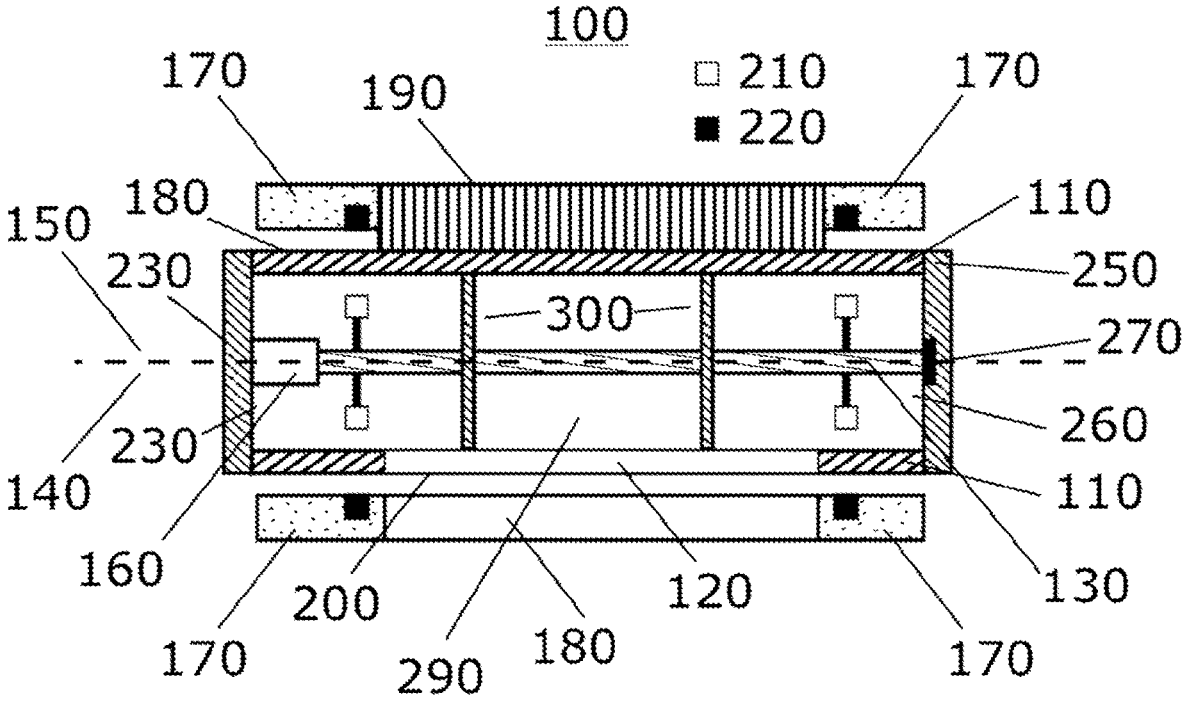
FIG. 6 is a schematic representation of a self-cleaning optical housing arrangement where the inner volume of the first cylindrical shell is partitioned by two essentially non-transparent walls.
Figure 9:
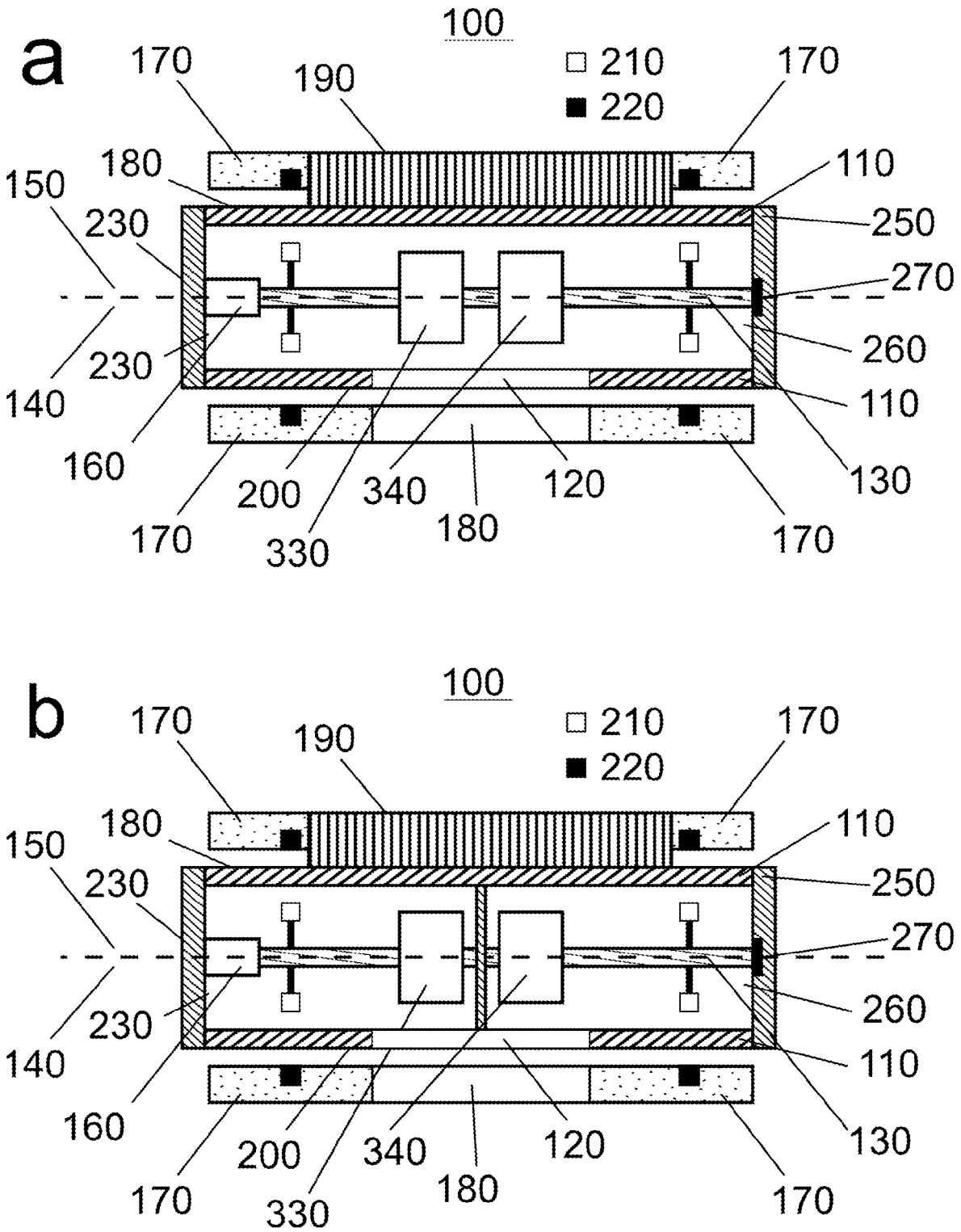
FIGS. 9*a* and 9*b* are schematic representations of a self-cleaning optical housing arrangement comprising an optical sensor and a light emitting device.

The optical housing arrangement 100 is according to the invention suitable for housing optical equipment, such as optical sensors, cameras, detectors, light sources, lenses, polarization filters, etc. The optical housing arrangement 100 is according to the invention intended for use underwater, and may therefore house at least one light emitting device for illuminating an object of interest outside the optical housing arrangement 100, and at least one optical sensor in order to capture an image of the illuminated object. This setup results, however, in a problem with light pollution, i.e. where light goes straight from the light emitting device to the optical sensor inside the housing, or through the transparent portion of the first cylindrical shell without having gone via the object of interest outside the housing. FIGS. 6 and 9 illustrates an embodiment of the present invention where potential problems with light pollution are limited by partitioning the inner volume 290 of the first cylindrical shell 110 by one or more essentially non-transparent walls 300. Essentially non-transparent may in this context be interpreted as having a visible light transparency of less than 1%. The inner volume 290 of the first cylindrical shell 110 may alternatively be partitioned by fully non-transparent walls. The problem of light pollution may in this setup be limited e.g. by separating the light emitting device and the optical sensor by such a said wall.

The self-cleaning optical housing arrangement may additionally be provided with electrical wiring in order to enable contact and/or power supply with any electrical and/or optical equipment within the optical housing arrangement. This wiring can for example go through any end cap of the housing arrangement, or alternatively be positioned in any other suitable spot. A slip ring may be used in order to transfer electricity to or in the optical housing arrangement.

Figure 7:
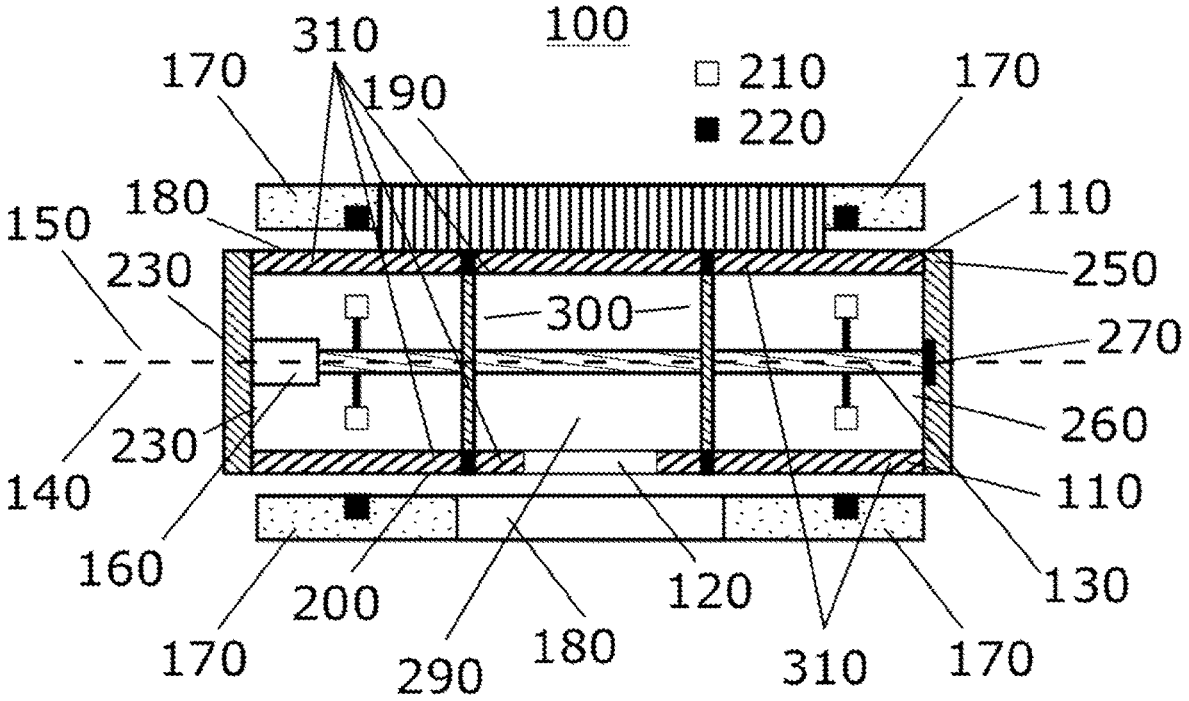
FIG. 7 is a schematic representation of a self-cleaning optical housing arrangement where the first cylindrical shell comprises a plurality of cylindrical shell segments.

FIG. 7 illustrates another embodiment of the invention where the first cylindrical shell 110 comprises a plurality of cylindrical shell segments 310 connected with each other. The plurality of cylindrical shell segments 310 may here further be partitioned from one another by one or more essentially non-transparent walls 300. The plurality of cylindrical shell segments 310 may alternatively be partitioned from one another by one or more fully non-transparent walls 300. Essentially non-transparent may in this context be interpreted as having a visible light transparency of less than 1%. The use of a plurality of cylindrical shell segments 310 may e.g. be beneficial when mounting the optical housing arrangement 100 together, and in order to avoid the first cylindrical shell acting as a waveguide. Each segment 310 may here be fabricated separately before being assembled into an optical housing arrangement 100.

Figure 8:
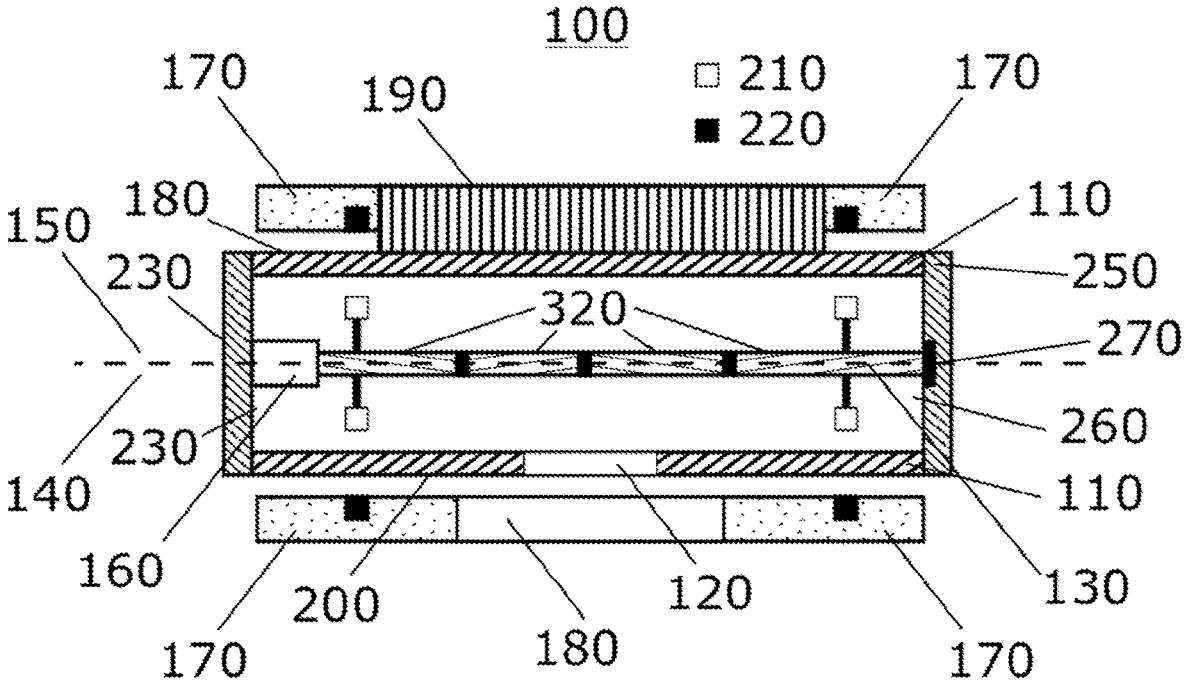
FIG. 8 is a schematic representation of a self-cleaning optical housing arrangement where the shaft comprises a plurality of parts.

The shaft 130 can in the context of the present invention generally take any form as long as it can rotate at least partly inside the inner volume 290 of the first cylindrical shell 110 relative to the first cylindrical shell 110. FIG. 8 illustrates the optical housing arrangement 100 according to one embodiment of the invention where the shaft 130 comprises a plurality of parts 320 connected with each other. The shaft 130 may in other words be a structure made up from two or more parts 320 fastened together.

FIG. 9 illustrates an embodiment of the invention where the optical housing arrangement 100 further comprises an optical sensor 330 and a light emitting device 340, both arranged in the inner volume 290 of the first cylindrical shell 110. The optical sensor 330 is here aligned such that it can detect light from outside the optical housing arrangement 100, e.g. by being arranged in front of the first transparent portion 120. The light emitting device 340, is in a similar manner aligned such that it may illuminate light out of the optical housing arrangement 100, e.g. onto an object of interest positioned outside the optical housing arrangement 100. The optical sensor 330 and the light emitting device 340 may be connected to the shaft 130 and may consequently be rotated by a rotation of the shaft 130. The optical sensor may in this embodiment of the invention be incorporated in a camera.

Figure 10:
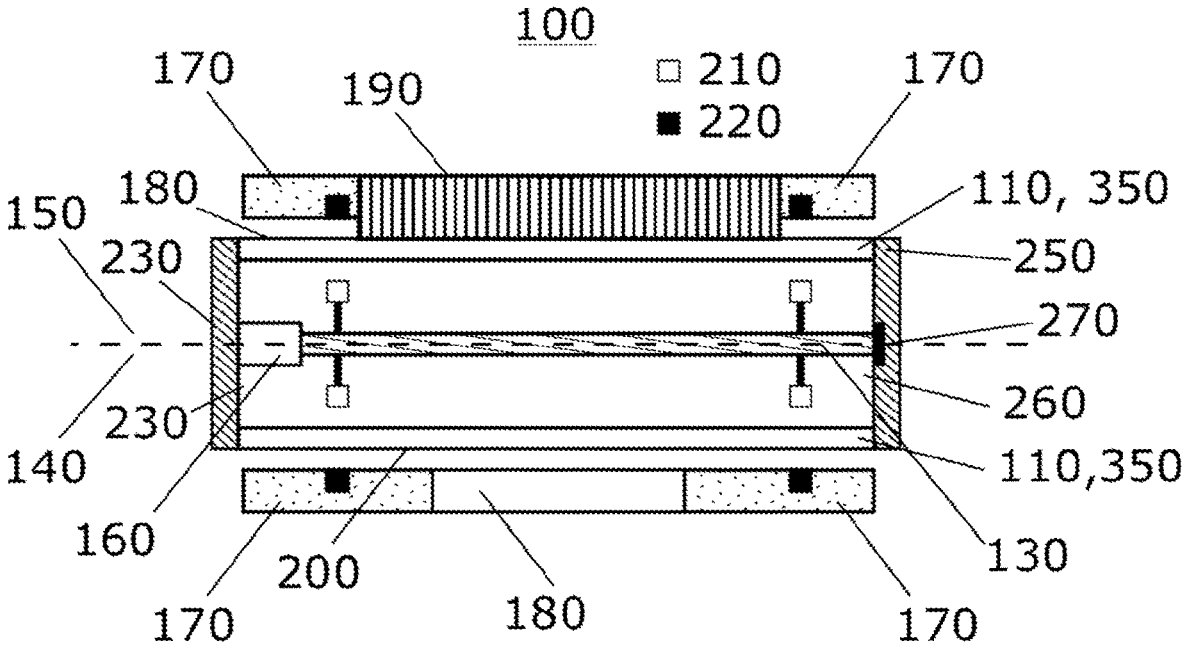
FIG. 10 is a schematic representation of a self-cleaning optical housing arrangement where the first cylindrical shell consists of a transparent material.

FIG. 10 illustrates an embodiment of the invention where the first cylindrical shell 110 is transparent, i.e. that the first cylindrical shell 110 consists of one or more transparent materials 350. The first cylindrical shell 110 may e.g. consist of one transparent material 350 such as soda-lime glass, silica, a transparent plastic, or any other suitable material. The first transparent portion 120 may thus make up the entire first cylindrical shell 110.

Figure 11:
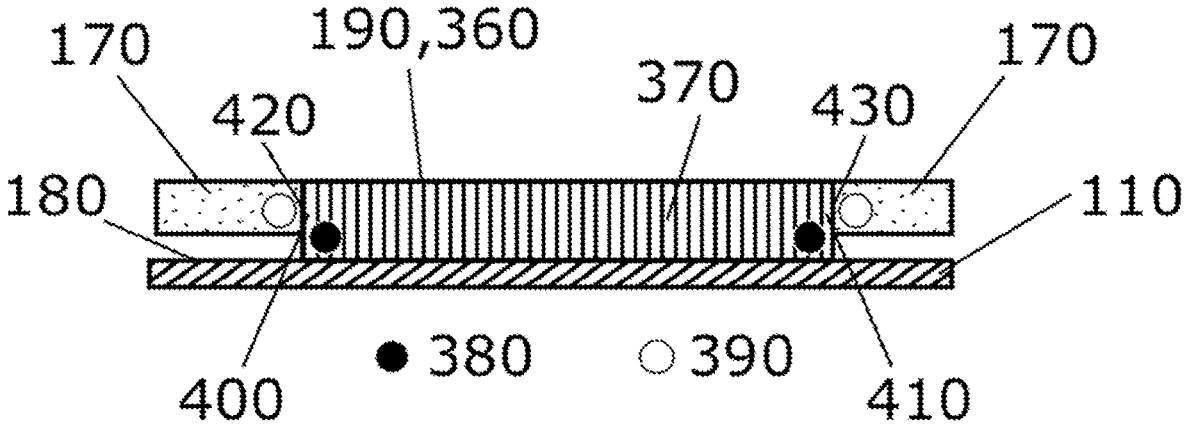
FIG. 11 is a schematic representation of a section of a self-cleaning optical housing arrangement where the cleaning pad has an elongated shape and where the second cylindrical shell element has an elongated slot.

FIG. 11 illustrates an embodiment of the invention where the cleaning pad 190, 360 has an elongated shape. An elongated shape may be beneficial for covering as large an area of the first cylindrical surface as possible without employing an unnecessarily large cleaning pad. The second cylindrical shell element 170 may in this embodiment of the invention have an elongated slot 370 shaped in as similar manner as the elongated cleaning pad 360 so that the cleaning pad 360 can be received in the slot 370. The elongated cleaning pad 360 may as illustrated in FIG. 11 be secured in the slot 370 by magnets. This can be performed by arranging a first and a second cleaning pad magnet 380 in the cleaning pad 360, while arranging a corresponding first and second mounting magnet 390 adjacent to the elongated slot 370. The magnets may here be positioned such that the first and second mounting magnets 390 exert a force on the first and a second cleaning pad magnets 380 respectively such that the cleaning pad 360 is pressed against the outer surface 200 of the first cylindrical shell 110. The force between the mounting magnets 390 and the cleaning pad magnets 380 may be either attractive, or repulsive as in the optical housing arrangement in FIG. 11. In the case where the force between the mounting magnets 390 and the cleaning pad magnets 380 is attractive, the mounting magnets 390 would have to arranged closer to the shaft axis of rotation 140 than the cleaning pad magnets 380. FIG. 11 illustrates an embodiment of the invention where the first and second cleaning pad magnets 380 are respectively arranged in a first and a second distal end 400, 410 of the cleaning pad 360. Here, the first and second mounting magnet are respectively arranged adjacent to a first and second distal end 420, 430 of the elongated slot 370.

| Term: | Figure reference |
|---|---|
| Self-cleaning optical housing arrangement | 100 |
| First cylindrical shell | 110 |
| First transparent portion | 120 |
| Shaft | 130 |
| Shaft axis of rotation | 140 |
| First cylindrical shell central axis | 150 |
| Motor | 160 |
| Second cylindrical shell element | 170 |

-continued

| Term: | Figure reference |
|---|---|
| Second transparent portion | 180 |
| Cleaning pad | 190 |
| First cylindrical shell outer surface | 200 |
| Shaft magnet | 210 |
| Cylinder magnet | 220 |
| First cap | 230 |
| First end of the first cylindrical shell | 240 |
| A second cap | 250 |
| Second end of the first cylindrical shell | 260 |
| A bearing | 270 |
| Opening | 280 |
| Inner volume of the first cylindrical shell | 290 |
| Non-transparent walls | 300 |
| Cylindrical shell segments | 310 |
| Shaft Part | 320 |
| Optical sensor | 330 |
| Light emitting device | 340 |
| Transparent material | 350 |
| Elongated cleaning pad | 360 |
| Elongated slot | 370 |
| Cleaning pad magnet | 380 |
| Mounting magnet | 390 |
| First distal end of the cleaning pad | 400 |
| Second distal end of the cleaning pad | 410 |
| First distal end of the slot | 420 |
| Second distal end of the slot | 430 |

The invention claimed is:

1. A self-cleaning optical housing arrangement comprising:

a first cylindrical shell including a first transparent portion;

a shaft arranged with a shaft axis of rotation along a first cylindrical shell central axis;

a motor connected to the first cylindrical shell and to the shaft, where the motor is configured to rotate the shaft relative to the first cylindrical shell;

a second cylindrical shell arranged at least in part around the first cylindrical shell and configured to rotate around the first cylindrical shell, the second cylindrical shell provided with a second transparent portion configured to be at least in part aligned with the first transparent portion;

a cleaning pad connected to the second cylindrical shell, and arranged at least in part between the first cylindrical shell and the second cylindrical shell so that the pad physically contacts a first cylindrical shell outer surface;

a shaft magnet connected to the shaft;

a cylinder magnet connected to the second cylindrical shell;

where the shaft magnet and the cylinder magnet are arranged in order to magnetically interact such that a rotation of the shaft causes the shaft magnet to exert a force on the cylinder magnet causing the second cylindrical shell to rotate with the shaft; and where the cleaning pad, upon rotation of the shaft and the second cylindrical shell, sweeps across and cleans, at least a part of the outer surface of the first transparent portion.

2. The arrangement according to claim 1, further comprising a first cap arranged on a first end of the first cylindrical shell such that the first cap forms a watertight seal with the first cylindrical shell.

3. The arrangement according to claim 2, where the motor is connected with the first cylindrical shell via the first cap.

4. The arrangement according to claim 1, further comprising:

a second cap arranged on a second end of the first cylindrical shell such that the second cap forms a watertight seal with the first cylindrical shell; and a bearing connected to the second cap and to the shaft, the bearing configured to secure the shaft to the second cap while allowing the shaft to rotate.

5. The arrangement according to claim 1, where the second transparent portion is an opening.

6. The arrangement according to claim 1, where an inner volume of the first cylindrical shell is partitioned by one or more essentially non-transparent walls.

7. The arrangement according to claim 1, where the first cylindrical shell comprises a plurality of cylindrical shell segments connected with each other, and where the plurality of cylindrical shell segments are partitioned by one or more essentially non-transparent walls.

8. The arrangement according to claim 1, further comprising:

an optical sensor configured to detect light from outside the optical housing arrangement; and a light emitter, configured to illuminate light out of the optical housing arrangement;

where the optical sensor and the light emitter are connected to the shaft and are arranged in an inner volume of the first cylindrical shell.

9. The arrangement according claim 6, further comprising:

an optical sensor configured to detect light from outside the optical housing arrangement; and a light emitter configured to illuminate light out of the optical housing arrangement;

where the optical sensor and the light emitter are connected to the shaft, are arranged in an inner volume of the first cylindrical shell and are separated by an essentially non-transparent wall.

10. The arrangement according to claim 1, where the shaft comprises a plurality of parts connected with each other.

11. The arrangement according to claim 1, comprising:

a plurality of shaft magnets, each connected to the shaft; and a plurality of a cylinder magnets, each connected to the second cylindrical shell;

where the shaft magnets and the cylinder magnets are arranged in order to magnetically interact such that a rotation of the shaft causes the shaft magnets to exert a force on the cylinder magnets causing the second cylindrical shell to rotate with the shaft.

12. The arrangement according to claim 1, where the first cylindrical shell consists of a transparent material.

13. The arrangement according to claim 1, where the cleaning pad has an elongated shape and where the second cylindrical shell has an elongated slot with a shape suitable for receiving the cleaning pad.

14. The arrangement according to claim 13, further comprising:

a first cleaning pad magnet and a second cleaning pad magnet arranged in the cleaning pad, and a first mounting magnet and a second mounting magnet, arranged adjacent to the elongated slot, where the first and second mounting magnets are configured to exert a force on the first and second cleaning pad magnets, respectively, such that the cleaning pad is pressed against the outer surface of the first cylindrical shell.

15. The arrangement according to claim 14, where the first and second cleaning pad magnets are respectively arranged in a first and a second distal end of the cleaning pad; and where the first and second mounting magnet are respectively arranged adjacent to a first and second distal end of the elongated slot.

* * * * *